United States Patent [19]

Freyrie

[11] 4,436,047

[45] Mar. 13, 1984

[54] BOOM FOR SAILBOARDS

[75] Inventor: Leonardo Freyrie, Milan, Italy

[73] Assignee: AMF Inc., White Plains, N.Y.

[21] Appl. No.: 375,254

[22] Filed: May 5, 1982

[30] Foreign Application Priority Data

May 5, 1981 [IT] Italy ..... 12517 A/81

[51] Int. Cl.[3] ..... B63H 9/04

[52] U.S. Cl. ..... 114/102; 114/39

[58] Field of Search ..... 114/39, 97, 98, 102

[56] References Cited

FOREIGN PATENT DOCUMENTS 2701243 7/1978 Fed. Rep. of Germany ..... 114/102

*Primary Examiner*—Trygve M. Blix

*Assistant Examiner*—Jesus D. Sotelo

[57] ABSTRACT

The free corner of a sail is secured to a boom containing mechanisms which transform the lateral forces acting on the boom into axial pulling forces on the sail end, thus maintaining the sail constantly in stretched condition, regardless of the elastic deformation undergone by the boom.

6 Claims, 6 Drawing Figures

BOOM FOR SAILBOARDS

BACKGROUND AND SUMMARY OF THE INVENTION

This invention relates to the sailboards, and more particularly to booms thereof.

It is known that the booms for sailboards are formed substantially by two curved spars which are joined to each other at their ends so as to form a substantially elliptical member, one end of the latter being secured to the mast to which the triangular sail is connected, the free corner of the sail being secured to the other end of the boom by means of a sheet.

When at sea, the navigator clings by the hands to one of the spars of the boom so as to balance the force of the wind acting on the sail.

However, this causes an elastic deformation of the boom, the extent of which increases with the force of the wind, whereby the transverse axis of the boom tends to lengthen and, therefore, the longitudinal axis to shorten.

Since the sail is secured in a stretched condition to the boom along the longitudinal axis thereof, said shortening of the longitudinal axis causes the sail to lose its stretched condition and to become loose just when its taut or stretched condition should be more necessary.

It is the main object of this invention, to overcome the drawbacks of the conventional booms for sailboards, by providing a boom which includes means for keeping a sail automatically and constantly in a stretched condition, regardless of the extent of deformation of the boom due to stresses thereon.

According to the general aspect of the invention, the free corner of the sail is secured to the aft end of the boom with the interposition of means which transform the lateral forces acting on the boom into axial pulling forces on the sail.

According to one embodiment of the invention, the two spars of the boom are connected together at the aft end of the boom by means of a short connecting rod, provided with two converging slots each into sliding engagement with two pins secured to the free ends of the corresponding spars, the free end of the sail being connected to the said connecting rod.

By virtue of the above arrangements, the sail is kept in the stretched condition constantly, regardless of the extent of deflection of the boom spars.

BRIEF DESCRIPTION OF THE DRAWINGS

Further characteristics and advantages of this invention will be more apparent from the following description of same preferred embodiments thereof, made with reference to the accompanying drawings, wherein.

DETAILED DESCRIPTION

Figure 1:
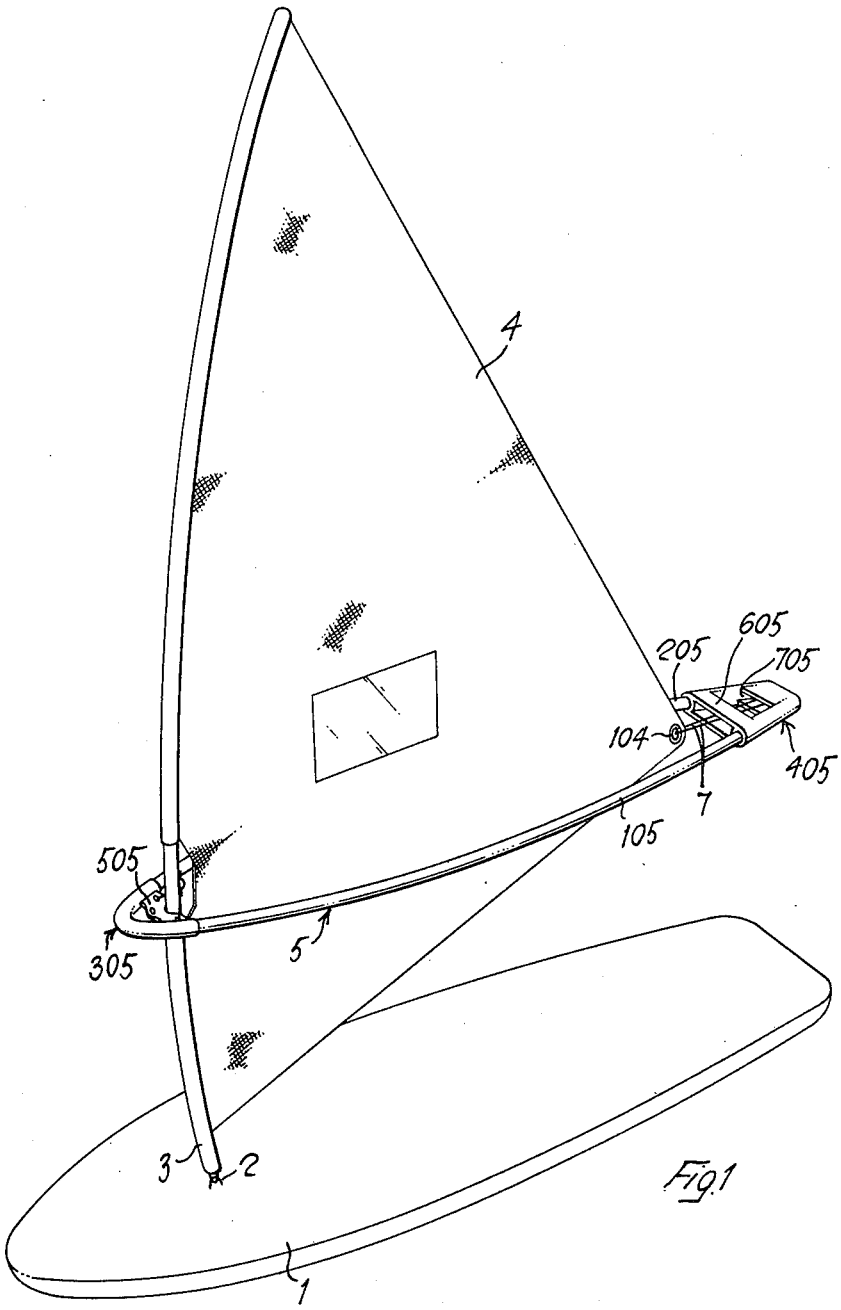
FIG. 1 is a perspective view of a sailboard with a mast and boom illustrating one method of assembly.
Figure 2:
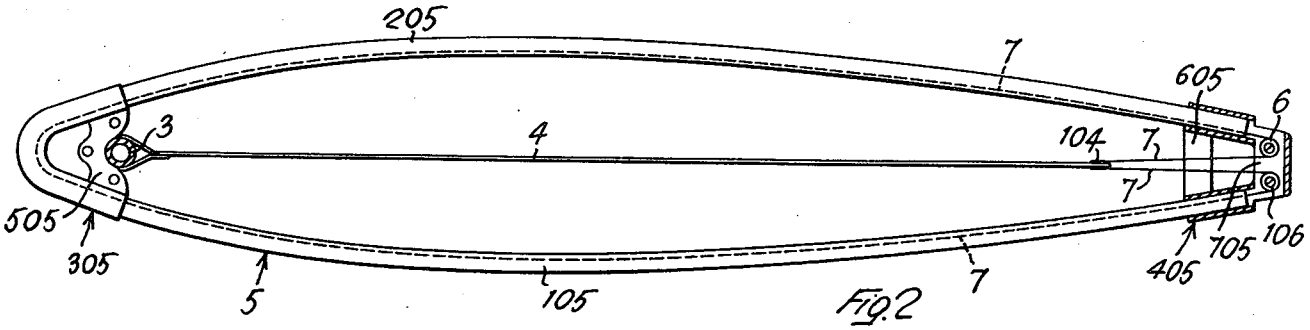
FIG. 2 is a plan view of the boom according to FIG. 1 with the aft end and the mast in section and, in the rest condition thereof, with the sail in the stretched condition.
Figure 3:
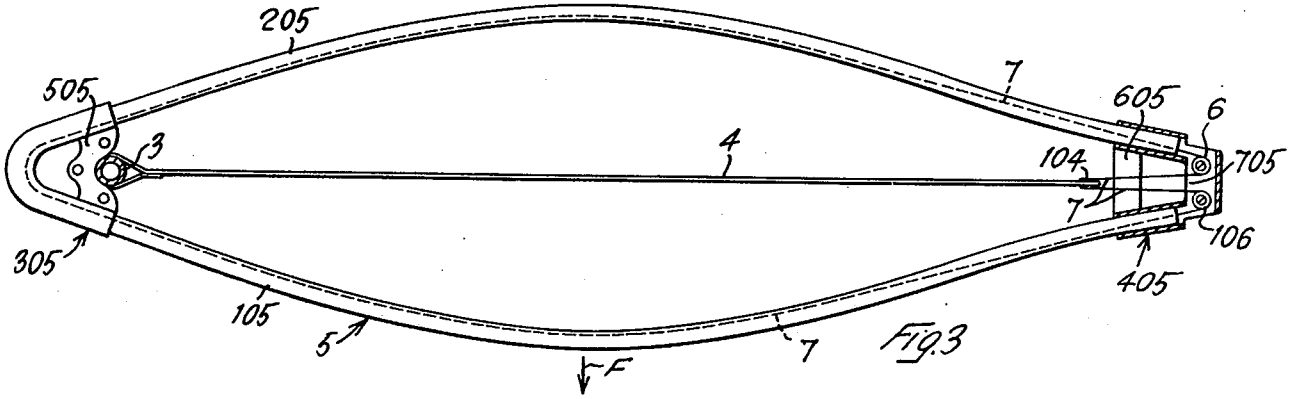
FIG. 3 shows the same boom of FIG. 2, distorted by the stresses exerted on the two spars thereof.

With reference to FIGS. 1 to 3 of the drawings, numeral 1 denotes the plank-hull of the sailboard. Connected by a universal joint 2 to the hull 1 is a mast 3 to which the longer side of a triangular sail 4 is connected.

The boom 5 for said sailboard comprises two curved tubular spars or arms 105, 205, which are joined to each other at the forward end thereof by means of a tubular connecting link 305, and at the aft end thereof by means of a tubular connecting link 405, so as to form a structure of substantially elliptical configuration. The connecting link 305 comprises a bridge member 505 provided with holes for receiving suitable sheets connecting the forward end of the boom to the mast 3. The connecting link 405 also comprises one or more spacing and/or reinforcing bridge members 605.

As best shown in FIGS. 2 and 3, the spars 105, 205 and the end connecting links 305, 405 are of tubular configuration and in open communication with one another. Moreover, the inner side of the tubular link 405 comprises an opening 705 for communication with the exterior. Two idler pulleys 6, 106 are fixed to the said link 405 at either sides of said opening 705 for the purposes set forth hereinafter.

The numeral 7 indicates a flexible, non extensible cable, for example a steel plait cable. This cable is passed from the exterior of the boom around the pulley 106 and therefrom into the spar 105, the forward link 305, and the spar 205 to the pulley 6 and therefrom again to the exterior to be joined to the other end of the cable 7. The free end of the sail 4 is secured to said joined ends of the cable 7 by a suitable eyelet 104 so that the sail 4 will be duly stretched over the boom 5.

When, due to a force F on one of the spars 105, 205 of the boom 5, the latter will be distorted so as to lengthen its shorter axis and to shorten its longer axis along which the sail is stretched (condition shown in FIG. 3), in a conventional arrangement the sail would become loose and would flap, and in certain conditions it would even lean against the opposite spar of the boom.

The desired end condition is to have the sheet tieing the free end of the sail to the aft end of the boom automatically shorten by the distance by which the fore-aft dimension of the boom is shortened, so that the slack that would otherwise be produced in the sail is taken up. This desired end condition for the rigging method illustrated is shown in FIG. 3 by the shortening of cable 7 between eyelet 104 and pulleys 6 and 106, although the method is not shown.

DESCRIPTION OF A SECOND EMBODIMENT OF THE INVENTION

Figure 4:
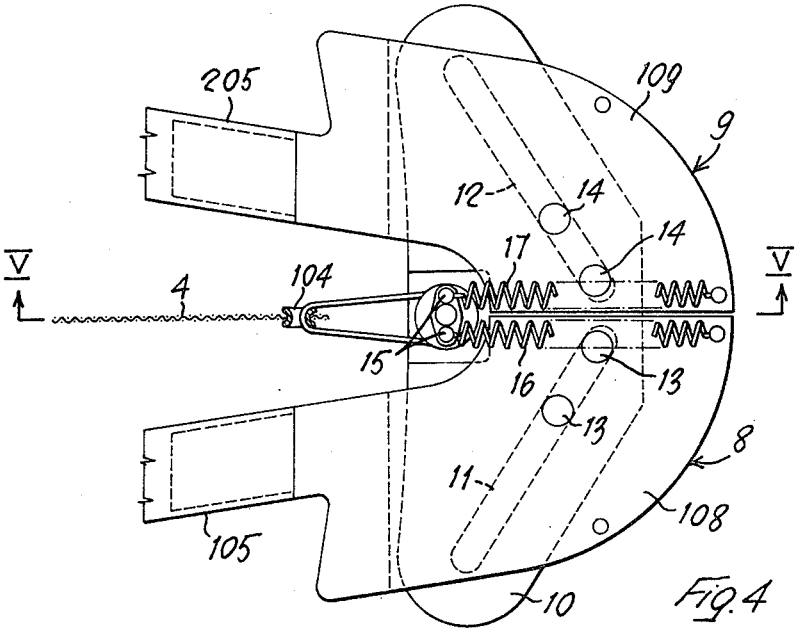
FIG. 4 is a plan view of the free end portion of a boom according to an embodiment of the invention, in the rest condition.
Figure 5:
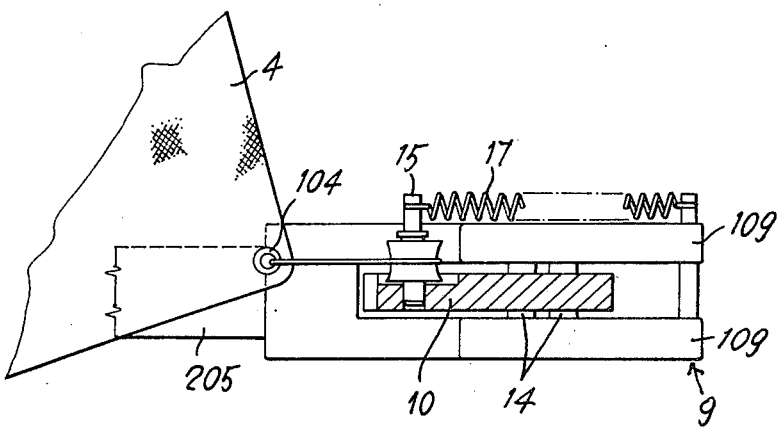
FIG. 5 is a cross sectional view taken along the line V—V of FIG. 4, corresponding to the longitudinal axis of the boom.
Figure 6:
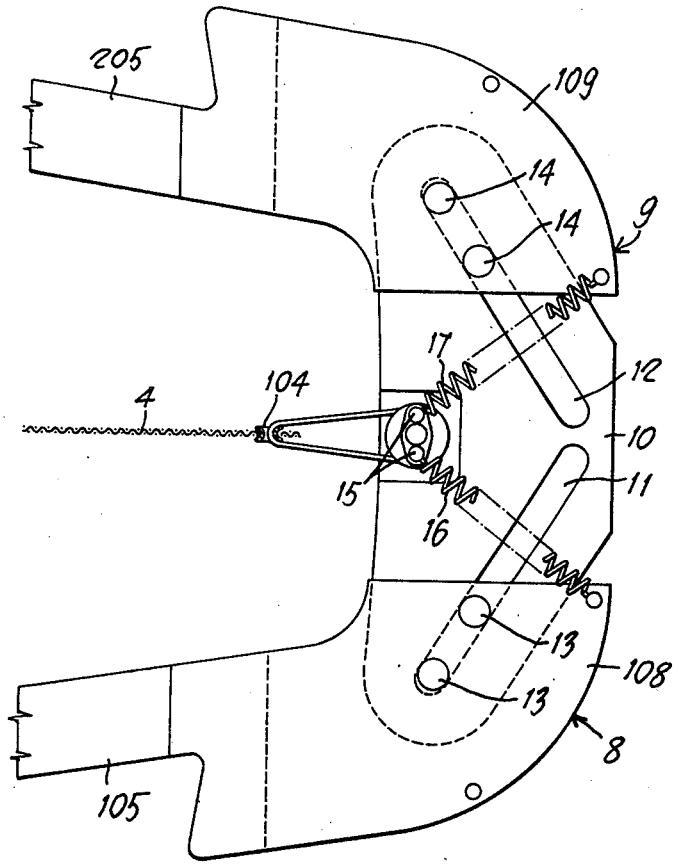
FIG. 6 is a view corresponding to FIG. 4, with the boom in the sail stretch compensating condition.

With reference to the FIGS. 4 to 6, an embodiment of the invention will be now described.

According to this embodiment, the two spars 105, 205 of the boom are each provided at their aft end with a U-shaped member 8, 9, respectively each comprising two parallel flat arms 108, 109. Between the arms 108, 109 a connecting plate 10 is slidably inserted. The plate 10 is provided with two rearwardly converging slots 11, 12, which are positioned into sliding engagement with two pairs of pins 13, 14 respectively secured to the arms 108, 109 of members 8, 9.

The plate 10 is provided in a central position with a fastening device including a pair of upstanding pins 15, and a sheave to which the eyelet 104 is secured. Two helical springs 16, 17 are mounted between the pins 15 and two other pins through both flat arms 108 and 109 of members 8, 9 which also serve to contain plate 10 within the arms 108, 109.

The operation of the described embodiment will be evident. By exerting a force on one of the spars 105, 205, of the boom, the plate 10 will slide rearwardly, thus stretching the sail, which is secured by its corner to the eyelet 104. The wind on the sail 4 exerts a force on the plate 10 through the sheave of the fastening device in a direction opposite to the force F of FIG. 3. The navigator pulling on spar 105 in the direction of force F to balance the wind force bows the spar 105 as also shown in FIG. 3 which pulls connected arm 108 in the same direction. Since the wind force through eyelet 104 is pulling on the fastening device and thereby on plate 10 in the opposite direction, arm 108 pulls away from its wind free or rest location with respect to plate 10. But the constraint of the slot 11 on the pin pairs 13 backs the plate 10 to the right with respect to arm 108 when spar 105 moves to the left and down as shown in FIG. 6 thus keeping the tension on the sail. The backward motion of plate 10 separates plate 109 through the similar constraint of slot 12 and pins 14.

The two springs 16, 17 are provided in order to assist in this sail-stretching action of plate 10. Their presence is however not essential.

What is claimed is:

1. A boom for sailboards having a mast and a substantially triangular sail secured along one side to the mast, the boom comprising: two spaced spars joined at their forward ends to each other and to the mast guide means in each spar aft end, and plate means slidably connecting together the aft ends of the boom spars to the free corner of the sail, the plate means containing a pair of directional means with which the spar guide means coact, whereby lateral forces on a boom spar move the guide means laterally against the directional means to force the plate means away from the mast and stretch the sail.

2. A boom according to claim 1, further comprising spring means for constantly urging said plate means in the sail stretching direction.

3. A boom according to claim 1, in which the said guide means are formed by two pins.

4. A boom according to claim 3 in which the directional means is a longitudinal slot which engages with the spar aft end pins.

5. A boom according to claim 1, in which the spars each include on their aft end a U shaped member comprising two parallel flat arms, between which the plate means is slidably guided for movement in the sail stretching direction.

6. A boom for sailboards having a mast and a substantially triangular sail secured along one side to the mast, the boom comprising: two spaced spars joined at their forward ends to each other and to the mast, plate means fastened to the free end of the sail and constrained by the aft ends of the spars for limited motion substantially along the longitudinal axis of the boom, and means actuated by motion of the spars substantially transverse to the longitudinal axis for moving the plate means along the axis to take up slack in the sail that would be produced by such spar motion.

* * * * *